US009253826B2

(12) United States Patent
Rundquist et al.

(10) Patent No.: US 9,253,826 B2
(45) Date of Patent: Feb. 2, 2016

(54) MICROWAVE FURNACE

(75) Inventors: Victor F. Rundquist, Carrollton, GA (US); William J. Gregory, Carrollton, GA (US); Kevin S. Gill, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 651 days.

(21) Appl. No.: 12/109,421

(22) Filed: Apr. 25, 2008

(65) Prior Publication Data

US 2008/0272113 A1 Nov. 6, 2008

Related U.S. Application Data

(60) Provisional application No. 60/926,299, filed on Apr. 26, 2007, provisional application No. 61/032,177, filed on Feb. 28, 2008.

(51) Int. Cl.

| | |
|---|---|
| ***H05B 6/70*** | (2006.01) |
| ***H05B 6/64*** | (2006.01) |
| ***H05B 6/76*** | (2006.01) |

(Continued)

(52) U.S. Cl.

CPC ..... *H05B 6/80* (2013.01); *F27B 17/0016* (2013.01); *F27D 99/0006* (2013.01)

(58) Field of Classification Search

CPC .. F27B 14/14; F27B 17/0016; F27D 99/0006; F27D 2099/0028; H05B 2206/044

USPC ..... 219/680, 690, 691, 678, 701, 709, 730, 219/744, 679, 695, 697, 759; 164/250.1, 164/335, 338.1, 48, 492

See application file for complete search history.

(56) References Cited

U.S. PATENT DOCUMENTS

| | | | | |
|---|---|---|---|---|
| 3,687,170 | A * | 8/1972 | Malone et al. | 138/143 |
| 3,732,048 | A | 5/1973 | Guerga et al. | 425/174.4 |

(Continued)

FOREIGN PATENT DOCUMENTS

| | | | |
|---|---|---|---|
| CN | 1339674 | A | 3/2002 |
| EP | 0 160 488 | A2 | 11/1985 |

(Continued)

OTHER PUBLICATIONS

International Search Report dated Jul. 17, 2008 cited in International Application No. PCT/US2008/061590.

(Continued)

*Primary Examiner* — Hung D Nguyen

(74) *Attorney, Agent, or Firm* — Merchant & Gould P.C.

(57) ABSTRACT

A system for melting a substance may be provided. The system may comprise a microwave generator, at least one wave guide, a melter assembly, and at least one thermal insulator. The at least one wave guide may connect the microwave generator to at least one power transfer element. The at least one wave guide may be configured to transfer microwave energy from the microwave generator to a refractory assembly. The melter assembly may comprise the refractory assembly and the at least one power transfer element connected to the refractory assembly. The refractory assembly may comprise at least one absorption element configured to transfer microwave energy, received from the at least one power transition element, into heat energy. The at least one thermal insulator may be configured to allow the microwaves to penetrate to the at least one absorption element.

22 Claims, 9 Drawing Sheets

(51) Int. Cl.

| | |
|---|---|
| ***H05B 6/80*** | (2006.01) |
| ***F27B 17/00*** | (2006.01) |
| ***F27D 99/00*** | (2010.01) |

(56) References Cited

U.S. PATENT DOCUMENTS

| | | | | |
|---|---|---|---|---|
| 3,951,904 | A | 4/1976 | Tomonaga | |
| 4,114,011 | A * | 9/1978 | Stubbs | 219/688 |
| 4,191,528 | A * | 3/1980 | Boggum et al. | 432/248 |
| 4,330,698 | A | 5/1982 | Sawada et al. | 219/10.55 |
| 4,496,950 | A | 1/1985 | Hemming et al. | |
| 4,638,268 | A | 1/1987 | Watanabe et al. | |
| 4,930,755 | A | 6/1990 | Ekerot et al. | 266/44 |
| 5,134,261 | A * | 7/1992 | Larkin et al. | 219/634 |
| 5,166,488 | A | 11/1992 | Peppard | 219/10.55 R |
| 5,168,917 | A | 12/1992 | Okuda et al. | 164/495 |
| 5,208,599 | A * | 5/1993 | Rudduck et al. | 342/4 |
| 5,358,223 | A * | 10/1994 | Bleijendaal et al. | 266/138 |
| 5,449,887 | A * | 9/1995 | Holcombe et al. | 219/679 |
| 6,782,669 | B1 * | 8/2004 | Dixon | 52/506.02 |
| 6,853,395 | B1 | 2/2005 | Becher | |
| 7,011,136 | B2 | 3/2006 | Moore et al. | 164/250.1 |
| 7,161,126 | B2 | 1/2007 | Ripley | |
| 8,357,885 | B2 | 1/2013 | Rundquist et al. | |
| 2001/0008773 | A1 | 7/2001 | Barclay et al. | |
| 2002/0027135 | A1 | 3/2002 | Fagrell et al. | |
| 2003/0089481 | A1 * | 5/2003 | Moore et al. | 164/250.1 |
| 2003/0111462 | A1 * | 6/2003 | Sato et al. | 219/700 |
| 2004/0056026 | A1 | 3/2004 | Jakes et al. | 219/701 |
| 2004/0107796 | A1 | 6/2004 | Kumar et al. | |
| 2004/0238794 | A1 * | 12/2004 | Karandikar et al. | 252/500 |
| 2005/0049138 | A1 * | 3/2005 | McGowan | 501/125 |
| 2005/0082282 | A1 | 4/2005 | Smrcek et al. | |
| 2006/0016805 | A1 * | 1/2006 | Del Regno | 219/680 |
| 2006/0096977 | A1 | 5/2006 | Ripley | |
| 2008/0142511 | A1 | 6/2008 | Ripley | 219/690 |
| 2009/0084780 | A1 | 4/2009 | Rundquist et al. | |
| 2010/0032429 | A1 | 2/2010 | Rundquist et al. | |

FOREIGN PATENT DOCUMENTS

| | | |
|---|---|---|
| JP | 10-107507 A | 4/1998 |
| JP | 2005-509832 | 4/2006 |
| JP | 2006-348367 | 12/2006 |
| WO | WO 00/00311 | 1/2000 |
| WO | WO 03/042616 | 5/2003 |

OTHER PUBLICATIONS

Copending U.S. Appl. No. 12/199,951, filed Aug. 28, 2008 entitled "Microwave Furnace".
International Search Report dated Oct. 7, 2009 cited in International Application No. PCT/US2009/054042.
T. Tsukagoshi, "Study on Microwave Energy Absorption in Wedge Type Electromagnetic Wave Absorber and Its Application to Microwave Heating", 1995, IEEE, pp. 568-572.
Copending U.S. Appl. No. 12/541,190, filed Aug. 14, 2009 entitled "Microwave Furnace".
International Search Report dated Nov. 16, 2010 cited in Application No. PCT/US2010/045473.
U.S. Office Action dated Aug. 11, 2011 cited in U.S. Appl. No. 12/199,951.
U.S. Final Office Action dated Jan. 18, 2012 cited in U.S. Appl. No. 12/199,951, 13 pgs.
European Communication dated Mar. 15, 2011 cited in Application No. 08 754 932.5.
European Communication dated Apr. 5, 2011 cited in Application No. 09791583.9.
Chinese First Office Action dated Feb. 13, 2012 cited in Application No. 200880020676.X, 15 pgs.
Japanese Notice of Reasons for Rejection dated May 16, 2013 cited in Application No. 2010-506523, 15 pgs.
U.S. Ex Parte Quayle Action dated Jul. 19, 2012 cited in U.S. Appl. No. 12/541,190, 16 pgs.
European Communication dated Jul. 27, 2011 cited in Application No. 09791583.9.
Chinese First Office Action dated Jul. 19, 2013, with Search Report, cited in Application No. 201080040706.0, 13 pgs.
Chinese Second Office Action dated Nov. 14, 2012 cited in Application No. 200880020676.X, 8 pgs.
Chinese Second Office Action dated Jul. 16, 2013 cited in Application No. 200980132990.1, 10 pgs.
Chinese First Office Action dated Dec. 3, 2012 cited in Application No. 200980132990.1, 11 pgs.
Chinese Third Office Action dated Dec. 30, 2013 cited in Application No. 200980132990.1, 7 pgs.
U.S. Office Action dated Apr. 8, 2014 cited in U.S. Appl. No. 12/199,951, 20 pgs.
Chinese Second Office Action dated Mar. 19, 2014 cited in Application No. 201080040706.0, 7 pgs.
U.S. Final Office Action dated Nov. 26, 2014 cited in U.S. Appl. No. 12/199,951, 22 pgs.

* cited by examiner

MICROWAVE FURNACE

RELATED APPLICATION

Under provisions of 35 U.S.C. §119(e), Applicants claim the benefit of U.S. provisional application No. 60/926,299, filed Apr. 26, 2007, and U.S. provisional application No. 61/032,177, filed Feb. 28, 2008, both of which are incorporated herein by reference.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

Metal melting is performed in a furnace. Virgin material, external scrap, internal scrap, and alloying elements are used to charge the furnace. Virgin material refers to commercially pure forms of the primary metal used to form a particular alloy. Alloying elements are either pure forms of an alloying element, like electrolytic nickel, or alloys of limited composition, such as ferroalloys or master alloys. External scrap is material from other forming processes such as punching, forging, or machining. Internal scrap consists of the gates, risers, or defective castings.

Furnaces are refractory lined vessels that contain the material to be melted and provide the energy to melt it. Modern furnace types include electric arc furnaces (EAF), induction furnaces, cupolas, reverberatory, and crucible furnaces. Furnace choice is dependent on the alloy system and quantities produced. Furnace design is a complex process, and the design can be optimized based on multiple factors.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

A system for melting a substance may be provided. The system may comprise a microwave generator, at least one wave guide, a melter assembly, and at least one thermal insulator. The at least one wave guide may connect the microwave generator to at least one power transfer element. The at least one wave guide may be configured to transfer microwave energy from the microwave generator to a refractory assembly. The melter assembly may comprise the refractory assembly and the at least one power transfer element connected to the refractory assembly. The refractory assembly may comprise at least one absorption element configured to transfer microwave energy, received from the at least one power transition element, into heat energy. The at least one thermal insulator may be configured to allow the microwaves to penetrate to the at least one absorption element.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
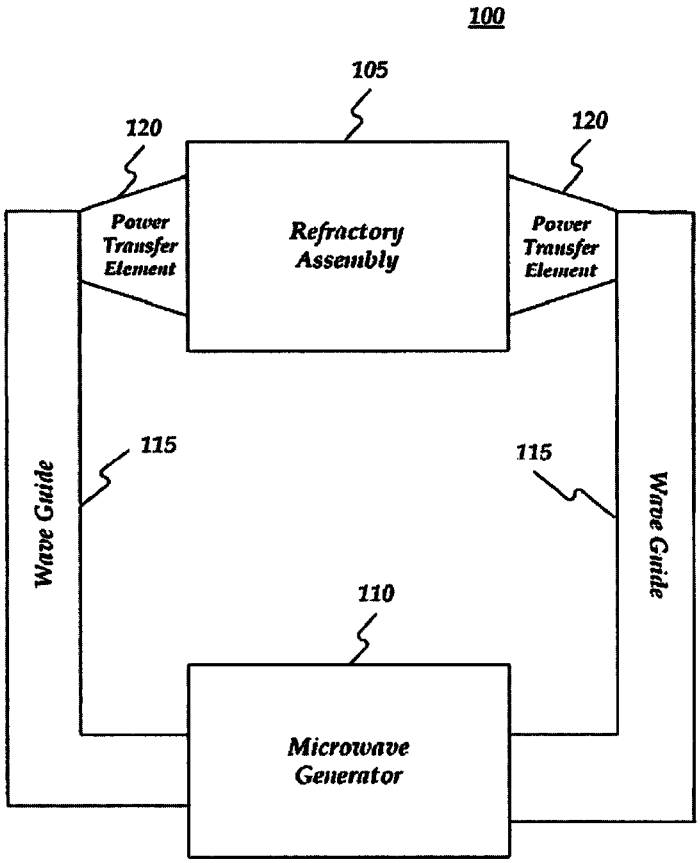
FIG. 1 shows a microwave furnace.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

A microwave furnace may be provided. Consistent with embodiments of the present invention, a microwave furnace may melt metals more efficiently and generate lower emissions than conventional furnaces. Consistent with embodiments of the invention, microwave energy may be used to generate heat inside a refractory wall. This heat may be transferred to a substance (e.g. metal) to be melted. The aforementioned substance may comprise any substance and is not limited to metal. The process may be continuous and may not leak hazardous amounts of microwave energy.

Furthermore, embodiments of the invention may crosslink polymers in-line. The process of crosslinking polymers may include heating the polymer to initiate the crosslinking reaction. Microwave energy may be applied to the polymer causing it to heat and the reaction to take place. This heat input to the polymer may occur quickly.

By using materials and certain geometries, the furnace's refractory walls may absorb a near maximum energy amount. A thermal insulation material may be used as a one-way energy device. This insulation material may allow microwave energy to flow freely while at the same time not allowing thermal energy to escape, for example, in a direction opposite to the microwave energy flow.

Embodiments of the invention may provide a method for melting using electrical energy. This process may avoid some or all issues associated with conventional melting. Moreover, processes consistent with embodiments of the invention may be cleaner, less dross or slag may be created during the melting process, and the molten substance's temperature may be easy to control. Furthermore, embodiments of the invention may avoid problems with conventional induction furnaces in that embodiments of the invention may not need to start with molten substance. Conventional induction furnaces must start with molten metal before more metal can be melted. In contrast, embodiments of the invention may start to heat with solid substance or even no substance.

Furthermore, embodiments of the invention may be modular. While, embodiments of the invention may include a module in a larger furnace, to increase the size, these modules may be stacked, for example, on top of one another and also end-to-end. The design of refractory may be modified to allow for the substance to flow from module to module. In addition, embodiments of the invention may allow for 'zone' heating. For example, by keeping lower modules hotter than upper modules, stirring may be induced in the molten substance through convection.

Also, embodiments of the invention may avoid the need for liquid cooling on the furnace. For example, none of the components near the furnace may require liquid cooling. This may reduce the chances of an explosion when water comes into contact with molten substance. Moreover, embodiments of the invention may at least be as efficient at melting as a conventional induction furnace. In addition, embodiments of the invention may be more efficient at melting aluminum than a conventional induction furnace, for example, because of aluminum's reduced melting temperature.

Embodiments of the invention may achieve a higher difference in the melting temperature of metal and the furnace walls when aluminum is used. For example, this aspect may be important to the furnace's ability to transfer energy into a metal, consistent with embodiments of the invention, the furnace may be designed to direct microwaves into proper material (e.g. absorption element) for heating. An efficient shape for the absorption element for absorbing microwaves may comprise, for example, a wedge shape with the thin edge facing the incoming microwaves. This wedge may be made of a material that is a good absorber of microwave energy. A good absorber may comprise a material that converts microwave energy into heat energy with minimal energy losses.

The absorption element for absorbing microwaves may be made of an absorbing material such as silicon carbide, for example. This material may absorb energy from both the magnetic field and electric field components of the microwave. The wedge shape of the silicon carbide absorption element may focus the energy from the microwaves into a specific point inside the absorption element. The material's electric properties along with the geometry may provide efficient microwave energy absorption.

The absorption elements may be insulated by insulating elements. The insulating elements may be made of a thermal insulation material that may be transparent to microwaves. This insulation material may be a good thermal and electrical insulator and may be a homogeneous material. For example, fused silica may be used to make the insulating elements because fused silica: i) has good electrical properties; ii) has a loss factor similar to that of air, which makes it transparent to Microwaves; and iii) has good thermal insulation characteristics. Furthermore, fused Silica may also withstand the temperatures required to melt metals.

Embodiments of the invention may also use a microwave generator comprising, for example, a power supply and a high power magnetron that creates the microwaves. The microwaves may then be directed to the furnace using various elements including a waveguide. Embodiments of the invention may provide a transition from the waveguide to the furnace without reflecting the microwaves off the fused silica insulation and without causing the microwaves to travel back to the microwave generator. This transition may facilitate energy transfer from the waveguide to the furnace and to simultaneously focus the microwave energy to obtain the desired shape before absorption.

FIG. 1 shows a microwave furnace 100 consistent with embodiments of the invention. Microwave furnace 100 may comprise a refractory assembly 105, a microwave generator 110, wave guides 115, and power transfer elements 120. Refractory assembly 105 and power transfer elements 120 may comprise a melter assembly consistent with embodiments of the invention.

Figure 2:
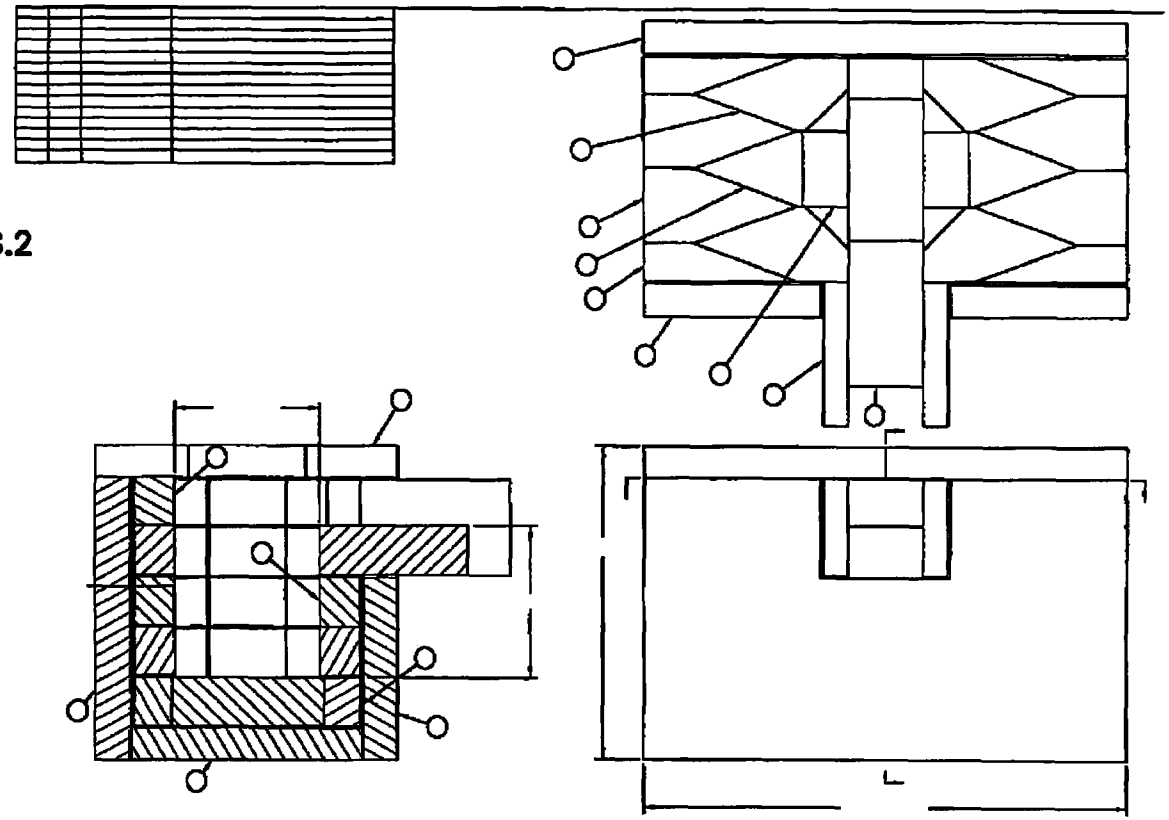
FIG. 2 shows a refractory assembly.
Figure 3:
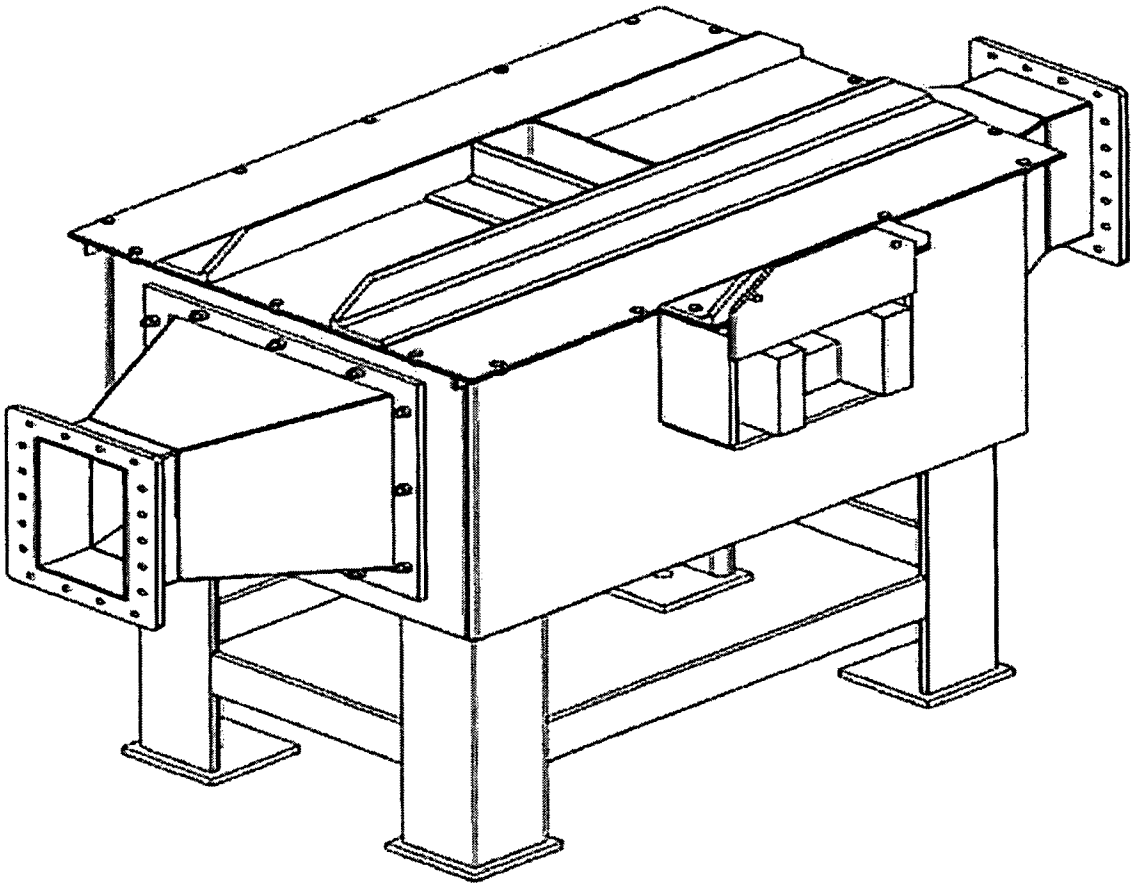
FIG. 3 shows a melter assembly.
Figure 4:
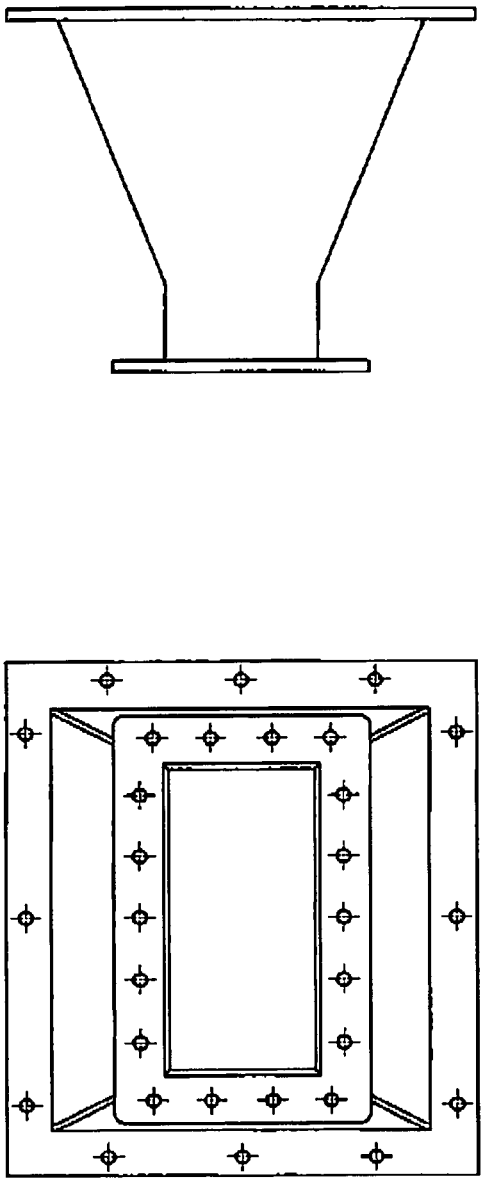
FIG. 4 shows power transfer elements.
Figure 5:
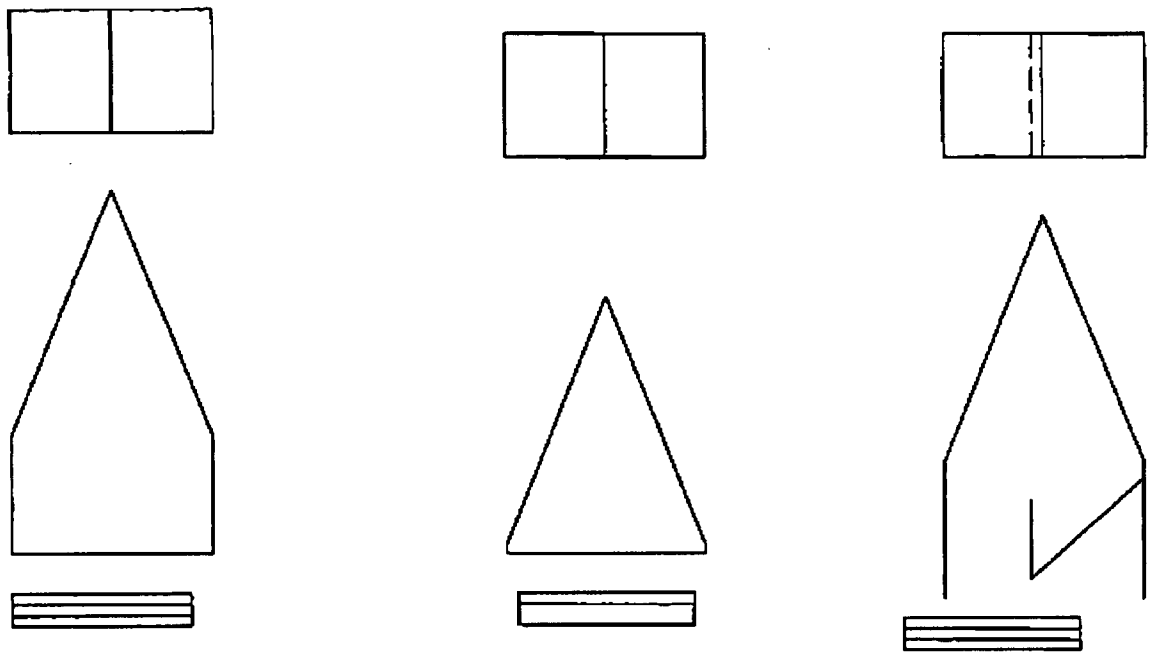
FIG. 5 shows examples of absorption elements.

FIG. 2 shows refractory assembly 105 in more detail. The silicon carbide parts (e.g. absorption elements) may be cast into one complete piece to avoid potentials for leaks. The fused silica shapes (e.g. insulation elements) may remain as individual bricks as shown. Refractory assembly 105 may be placed into the melter assembly as shown in FIG. 3. As shown in FIG. 3, power transfer elements 120 may be placed on the sides. Power transfer elements 120 may provide transfer from wave guides 115 to refractory assembly 105. Refractory assembly 105 may include cold metal addition window on the top and the hot metal pour spout on the front. Both may be designed to allow metal to enter and leave furnace 100 and at the same time prevent microwave energy from escaping. FIG. 4 shows power transfer elements 120 in more detail. FIG. 5 shows examples of the aforementioned absorption elements (e.g. wedge shaped silicon carbide).

Figure 6:
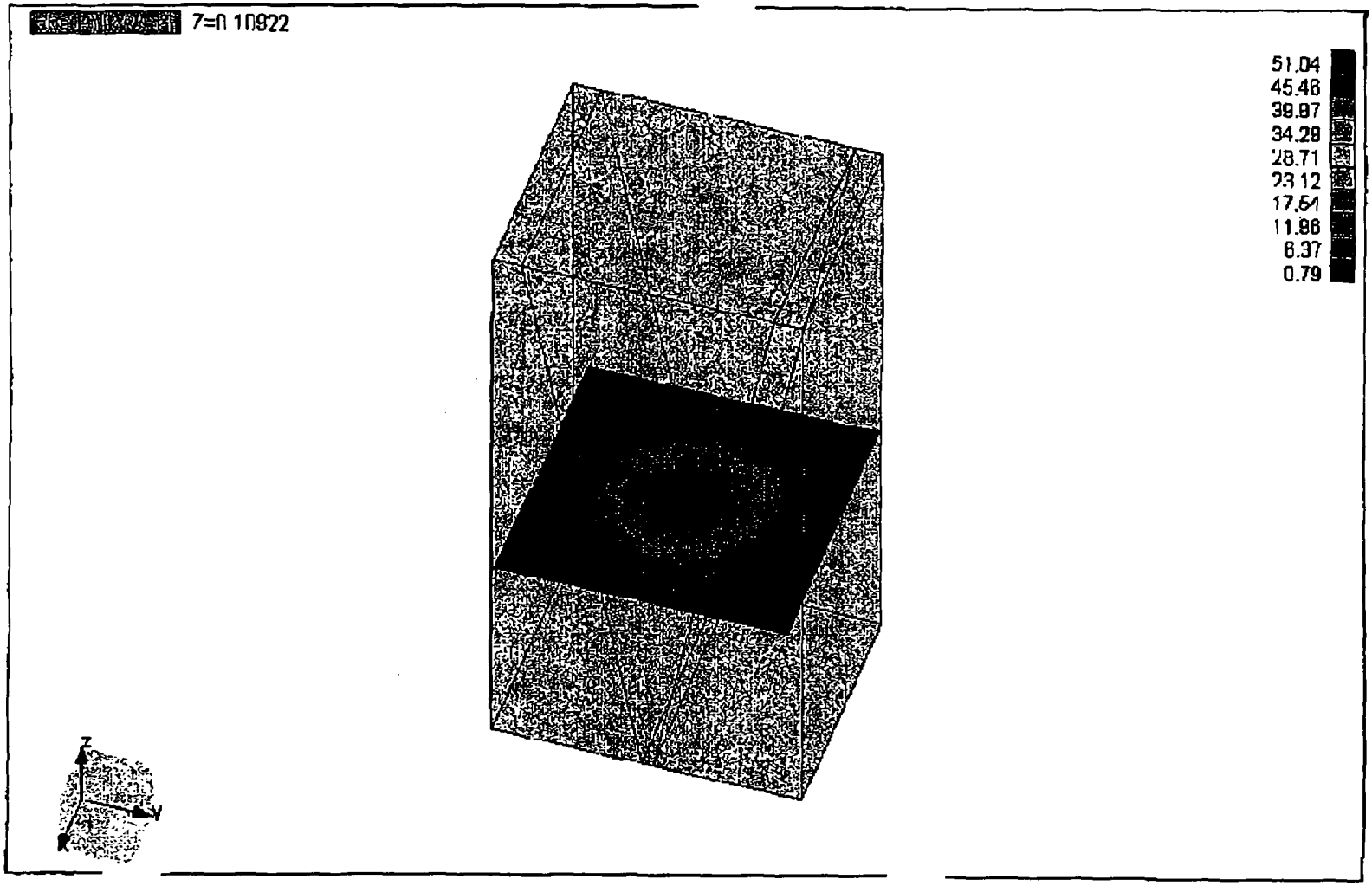
FIG. 6 shows an energy absorption simulation for absorption elements.
Figure 7:
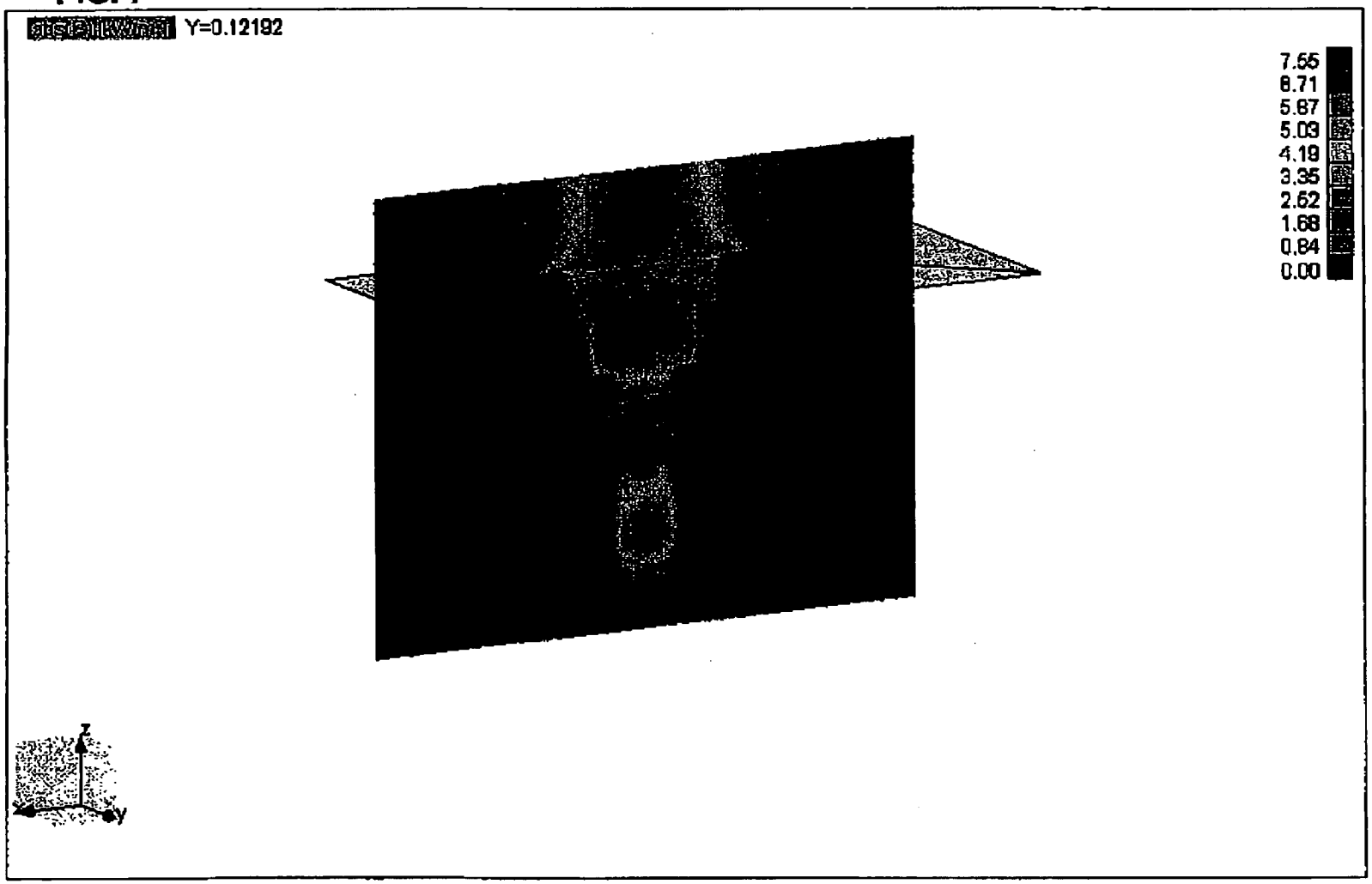
FIG. 7 shows a focal pattern of microwaves as they enter a melter assembly.

FIG. 6 shows energy absorption simulation of the aforementioned absorption elements. FIG. 6 illustrates a focusing effect of the silicon carbide wedge bricks and the power transfer assembly. The wedge shape was simulated and the focusing effect was confirmed. FIG. 7 shows the focal pattern of the microwaves as they enter the melter assembly.

Figure 8:
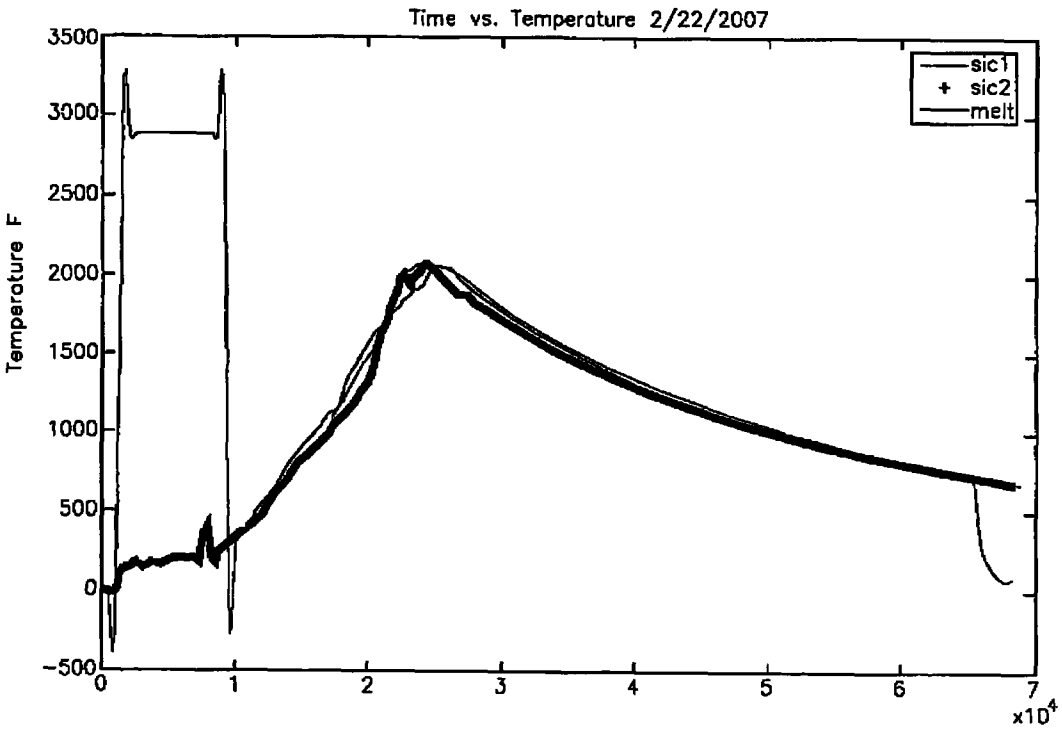
FIG. 8 shows a graph of temperature results for curing the microwave furnace.

FIG. 8. shows, for example, a graph of temperature results for curing microwave furnace 100. The test data may include the following:

Time to heat furnace to melting temp

Overall Melting Efficiency

Defined as $$\frac{E_{Cu}}{E_{Gen}} * 100\%$$

$E_{Cu}$=Theoretical energy to melt set amount of copper $E_{Gen}$=Amount of energy consumed by microwave generator Microwave to melted Copper Efficiency Defined as $$\frac{E_{Cu}}{E_{Wg}} * 100\%$$

$E_{Wg}$=Microwave energy delivered to furnace

In the test shown in FIG. 8, the furnace did reach the required temperature to cure the refractory mortar. The furnace, exceeded melt point for copper Preliminary analysis revealed the following:

$T_1$=Time copper was inserted into furnace.

$T_2$=Time copper was melted $\Delta T$=Total time required to melt the copper in seconds.

Average watts*$\Delta T$=$J_1$=joules of energy used.

$J_c$=Amount of energy required to melt x lbs of copper.

$$\frac{Jc}{J_1} * 100\% = \text{efficiency of melting copper.}$$

In the test shown in FIG. 8, using this formula and 45 lbs of copper, the efficiency of the melting apparatus was approximately 60% from MW energy to melted copper and 48% from electrical energy to melted copper.

Figure 9:
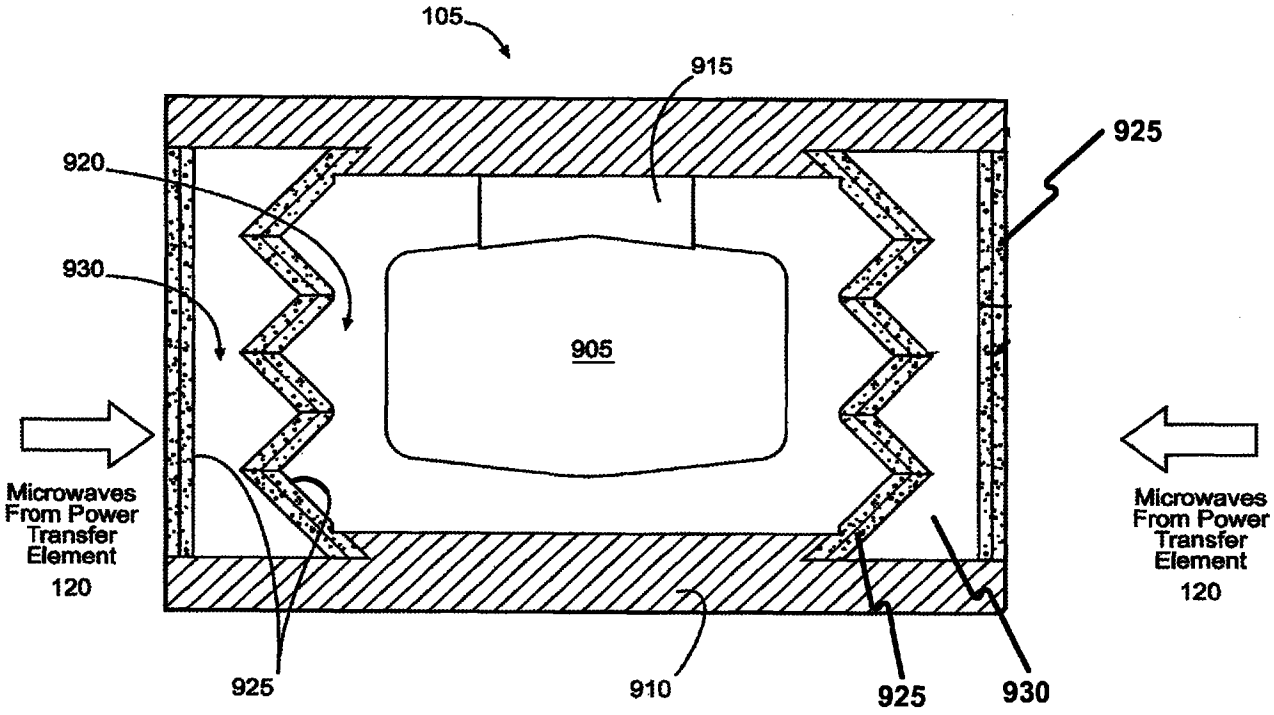
FIG. 9 shows a refractory assembly.

FIG. 9 shows other embodiments of refractory assembly 105. As shown in FIG. 9, refractory assembly 105 may comprise a crucible 905, insulation elements 910, a spout 915, an absorption element 920, boards 925, and gaps 930. Microwave energy may be received from power transfer elements 120 as shown in FIG. 9. Absorption element 920 may comprise silicon carbide, insulation elements 910 may comprise fused silica, and gaps 930 may comprise sealed air gaps. Insulation elements 910 may be configured to insulate heat into crucible 905.

Boards 925 may comprise silica and alumina fiberboards that may be arranged in assembly 105 so as to present the least amount of material to the microwaves, but still provide adequate thermal insulation. Boards 925 may be placed outside a zone of the highest electromagnetic energy density in assembly 105. Gaps 930 between some of boards 925 may facilitate energy removal from the boards 925. While no material may be perfectly microwave transparent, any losses that may occur in the material must be dissipated somewhere. For example, boards 925 that are furthest away from absorption element 920 may radiate any losses into power transfer elements 120 and into a furnace shell containing refractory assembly 105. Boards 925 that are attached to crucible 905 may conduct their energy into crucible 905. Boards 925 may comprise just boards or a combination of fibrous blankets and boards. Also, boards 925 may be configured to create a freeze plane for molten metal.

Silicon carbide parts (e.g. absorption element 920) may be cast into one complete piece to avoid potentials for leaks. Fused silica parts (e.g. insulation elements 910) may remain as individual bricks. Refractory assembly 105 may be placed into the melter assembly as described above with respect to FIG. 3. As shown in FIG. 3, power transfer elements 120 may be placed on the sides of assembly 105. Power transfer elements 120 may provide transfer from wave guides 115 to refractory assembly 105. Refractory assembly 105 may include a cold metal addition window on the top and a hot metal pour spout (e.g. spout 915) on the front. Both may be designed to allow metal to enter and leave furnace 100 and at the same time prevent microwave energy from escaping.

Consistent with embodiments of the invention, microwave furnace 100 may be used to perform a continuous melting process. For example, microwaves from microwave generator 110 may be transmitted through wave guides 115 to power transfer elements 120. As described above, the microwaves may be converted to heat and metal in crucible 905 may be melted by the heat. Refractory assembly 105 may include a cold metal addition window on the top and a hot metal pour spout (e.g. spout 915) on the front. Consequently, the continuous melting process may allow metal to enter (e.g. through cold metal addition window) and leave (e.g. through spout 915) microwave furnace 100 and at the same time prevent microwave energy from escaping. Power transfer elements 120 may be configured to match impedance between wave guides 115 and refractory assembly 105 to maximize energy transfer from wave guides 115 to refractory assembly 105. The continuous melting process may be controlled by a computer running a program module. Among other things, the program module may monitor and/or control the microwaves generated by microwave generator 110 and the amount of metal entering and leaving microwave furnace 100.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

All rights including copyrights in the code included herein are vested in and the property of the Applicant. The Applicant retains and reserves all rights in the code included herein, and grants permission to reproduce the material only in connection with reproduction of the granted patent and for no other purpose.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A system for melting a substance, the system comprising:

a microwave generator;

at least one wave guide connecting the microwave generator to at least one power transfer element, the at least one wave guide configured to transfer microwave energy from the microwave generator to a refractory assembly;

a melter assembly comprising the refractory assembly and the at least one power transfer element being connected to the refractory assembly, the refractory assembly comprising;

a crucible, and at least one absorption element adjacent the crucible, the at least one absorption element being cast of one piece and having a plurality of wedge shapes configured to convert microwave energy, received from the at least one power transfer element, into heat energy, the plurality of wedge shapes each having the same geometry and having a thin edge facing the at least one power transfer element, wherein the crucible is configured to receive the heat energy from the at least one absorption element, wherein an axis passing along the thin edge of each of the plurality of wedge shapes is substantially perpendicular to a direction from which the microwave energy is received from the at least one power transfer element; and at least one thermal insulator configured to allow microwaves from the at least one wave guide to penetrate to the at least one absorption element wherein the at least one thermal insulator comprises at least two thermal insulation boards wherein the thermal insulator is configured to first pass the microwaves through a first of the at least two thermal insulation boards and then through a second of the at least two thermal insulation boards prior to the microwaves penetrating to the at least one absorption element.

2. The system of claim 1, wherein the at least one thermal insulator comprises a gap between the at least two thermal insulation boards.

3. The system of claim 2, wherein the gap comprises a sealed air gap.

4. The system of claim 2, wherein the gap is configured to dissipate heat energy from the at least two thermal insulation boards.

5. The system of claim 1, wherein the at least two thermal insulation boards comprise silica and alumina fiberboards.

6. The system of claim 1, wherein the at least two thermal insulation boards are located outside a zone of highest electromagnetic energy density in the refractory assembly.

7. The system of claim 1, wherein a first one of the at least two thermal insulation boards is adjacent the power transfer element and a second one of the at least two thermal insulation boards is adjacent the at least one absorption element.

8. The system of claim 1, wherein the at least one absorption element comprises silicon carbide.

9. The system of claim 1, wherein the at least one absorption element comprises a one piece cast of silicon carbide.

10. The system of claim 1, further comprising a metal addition window configured to receive un-melted metal into the crucible.

11. The system of claim 10, wherein the metal addition window is configured to prevent microwave energy from escaping the refractory assembly.

12. The system of claim 1, further comprising a spout configured to allow melted metal to leave the crucible.

13. The system of claim 12, wherein the spout is configured to prevent microwave energy from escaping the refractory assembly.

14. The system of claim 1, wherein the refractory assembly further comprises at least one insulation element configured to retain heat in the crucible.

15. The system of claim 14, wherein the at least one insulation element comprises fused silica.

16. The system of claim 14, wherein the at least one insulation element comprising a plurality of individual bricks.

17. The system of claim 1, wherein the at least one thermal insulator comprises one of the following: boards and a combination of a fibrous blanket and a board.

18. The system of claim 1, wherein the at least one thermal insulator is configured to create a freeze plane for molten metal.

19. The system of claim 1, wherein the thin edge is substantially parallel with the second one of the at least two thermal insulation boards.

20. The system of claim 1, wherein the thin edge is substantially parallel with a surface of the at least one power transfer element.

21. A system for melting a substance, the system comprising:

a melter assembly comprising a refractory assembly and at least one power transfer element being connected to the refractory assembly, the refractory assembly surrounding a crucible and comprising at least one absorption element, the at least one absorption element being cast of one piece and having a plurality of wedge shapes each having the same geometry and configured to convert microwave energy into heat energy, the plurality of wedge shapes each having a thin edge facing the at least one power transfer element, wherein an axis passing along the thin edge of each of the plurality of wedge shapes is substantially perpendicular to a direction from which the microwave energy is received from the at least one power transfer element; and at least one thermal insulator configured to allow microwaves from the at least one wave guide to penetrate to the at least one absorption element, wherein the at least one thermal insulator comprises;

at least two thermal insulation boards placed outside a zone of highest electromagnetic energy density in the refractory assembly wherein the thermal insulator is configured to first pass the microwaves through a first of the at least two thermal insulation boards and then through a second of the at least two thermal insulation boards prior to the microwaves penetrating to the at least one absorption element, and a gap between the at least two thermal insulation boards.

22. A system for melting a substance, the system comprising:

a microwave generator;

at least one wave guide connecting the microwave generator to at least one power transfer element, the at least one wave guide configured to transfer microwave energy from the microwave generator to a refractory assembly;

a melter assembly comprising the refractory assembly and the at least one power transfer element being connected to the refractory assembly, the refractory assembly comprising at least one absorption element having a plurality of wedge shapes configured to convert microwave energy, received from the at least one power transfer element, into heat energy, the plurality of wedge shapes each having a thin edge facing the at least one power transfer element, wherein an axis passing along the thin edge of each of the plurality of wedge shapes is substantially perpendicular to a direction from which the microwave energy is received from the at least one power transfer element, the at least one absorption element comprising a one piece cast of silicon carbide;

at least one thermal insulator configured to allow microwaves from the at least one wave guide to penetrate to the at least one absorption element, wherein the at least one thermal insulator comprises:

at least two thermal insulation boards comprising silica and alumina fiberboards and being placed outside a zone of highest electromagnetic energy density in the refractory assembly, wherein a first one of the at least two thermal insulation boards is adjacent the power transfer element, a second one of the at least two thermal insulation boards is adjacent the at least one absorption element, and the first one of the at least two thermal insulation boards is adjacent the second one of the at least two thermal insulation boards, and a gap between the at least two thermal insulation boards, wherein the gap comprises a sealed air gap and is configured to dissipate heat energy from the at least two thermal insulation boards;

a crucible configured to receive heat energy from the at least one absorption element, the crucible comprising a metal addition window configured to receive un-melted metal into the crucible and a spout configured to allow melted metal to leave the crucible wherein the metal addition window and the spout are configured to prevent microwave energy from escaping the refractory assembly; and at least one insulation element configured to insulate heat in the crucible, wherein the at least one insulation element comprises a plurality of individual fused silica bricks.

* * * * *